US009622940B2

(12) United States Patent
Uetake

(10) Patent No.: US 9,622,940 B2
(45) Date of Patent: Apr. 18, 2017

(54) MEDICINE PACKAGING PTP SHEET

(71) Applicant: Nipro Corporation, Osaka (JP)

(72) Inventor: Kazuaki Uetake, Saitama (JP)

(73) Assignee: Nipro Corporation, Osaka (JP)

( * ) Notice: Subject to any disclaimer, the term of this patent is extended or adjusted under 35 U.S.C. 154(b) by 0 days.

(21) Appl. No.: 14/363,070

(22) PCT Filed: Dec. 7, 2012

(86) PCT No.: PCT/JP2012/081802
§ 371 (c)(1),
(2) Date: Jun. 5, 2014

(87) PCT Pub. No.: WO2013/085036
PCT Pub. Date: Jun. 13, 2013

(65) Prior Publication Data

US 2014/0326635 A1 Nov. 6, 2014

(30) Foreign Application Priority Data

Dec. 9, 2011 (JP) ..... 2011-007307
Dec. 9, 2011 (JP) ..... 2011-270683

(51) Int. Cl.
*A61J 1/03* (2006.01)
*B65D 75/32* (2006.01)
*A61J 7/04* (2006.01)

(52) U.S. Cl.
CPC ..... *A61J 1/035* (2013.01); *B65D 75/327* (2013.01); *A61J 7/04* (2013.01); *A61J 2205/30* (2013.01); *B65D 2575/3263* (2013.01); *B65D 2575/3281* (2013.01)

(58) Field of Classification Search
CPC . A61J 7/04; A61J 2205/30; B65D 2575/3281; B65D 2575/3263
See application file for complete search history.

(56) References Cited

U.S. PATENT DOCUMENTS 3,743,084 A * 7/1973 Douglas ..... B65D 75/327 206/532
4,120,399 A * 10/1978 Clarke ..... B65D 83/0445 206/1.5
4,736,849 A * 4/1988 Leonard ..... A61J 1/03 116/308

(Continued)

FOREIGN PATENT DOCUMENTS

JP 41-10138 5/1966
JP 59-106871 7/1984

(Continued)

*Primary Examiner* — Andrew Perreault
(74) *Attorney, Agent, or Firm* — Jordan and Koda, PLLC

(57) ABSTRACT

A medicine packaging PTP sheet capable of protecting a pocket from pressurization by external force in a combined state in which the medicine packaging PTP sheet has a first sheet in which a pocket capable of accommodating a medicine and a projecting convex portion each are projected from the upper surface and a second sheet which is attached to the lower surface of the first sheet and blocks an opening of the pocket. A first distance L1 from the upper surface of the first sheet to the projection end of the convex portion is longer than a second distance L2 from the upper surface of the first sheet to the projection end of the pocket.

6 Claims, 9 Drawing Sheets

(56) References Cited

U.S. PATENT DOCUMENTS

| | | | | | |
|---|---|---|---|---|---|
| 5,878,885 | A | | 3/1999 | Wangu et al. | |
| D421,900 | S | * | 3/2000 | Eneroth | D9/732 |
| D689,373 | S | * | 9/2013 | Logue | D9/732 |

FOREIGN PATENT DOCUMENTS

| | | |
|---|---|---|
| JP | 10-264964 | 10/1998 |
| JP | 2005-211578 | 8/2005 |
| JP | 2006-297012 | 11/2006 |
| KE | 2011-037527 | 2/2011 |

* cited by examiner (A)

(B)

MEDICINE PACKAGING PTP SHEET

TECHNICAL FIELD

The present invention relates to a medicine packaging PTP sheet.

BACKGROUND OF THE INVENTION

PTP (Press Through Package) packaging has been widely used for packaging solid medicines, such as tablets and capsule agents, in the field of packaging of pharmaceuticals. The PTP packaging mainly refers to a packaging body (sheet) in which pockets which accommodate a medicine are molded in a resin film, the pockets are filled with medicines, and then the pockets are sealed by a sheet containing aluminum foil (hereinafter simply referred to as aluminum foil).

The medicine is taken out from the PTP sheet by the following procedure. When a patient presses the medicine over a pocket by a fingertip, the pocket is elastically deformed, and then the medicine is pressed against the aluminum foil. The aluminum foil is broken by the medicine, so that the medicine comes to the outside of the pocket.

When medicines are stored or transported or medicines are carried by patients, a plurality of PTP sheets are laminated to each other in some cases. In that case, the PTP sheets are laminated to each other in such a manner that the surfaces to which the pockets are projected face each other in many cases. In the state where the sheets ere laminated to each other in this way, since the pockets of one PTP sheet are located in the gap between the pockets of the other PTP sheet. Therefore, the entire thickness in the state where the two PTP sheets are laminated to each other becomes small. Simultaneously, the pockets can be prevented from being directly pressurized by external force. Hereinafter, this state is also referred to as a combined state. Patent Literature 1 discloses a device and a method capable of realizing the combined state of the PTP sheets at high speed.

Moreover, heretofore, a pharmacist sometimes enters information on a medicine, such as the time when a patient takes a medicine, on the PTP sheet which packages the medicine. When the information on the medicine is entered on the PTP sheet, the patient who has confirmed the information can take a medicine with the correct usage.

However, since a common medicine packaging PTP sheet is a molded article of a resin film, a paint is difficult to adhere. Therefore, it is difficult to enter characters and patterns on a packaged PTP sheet with pens and pencils, such as a pencil, a ballpoint pen, or a mechanical pencil. In order to solve such a problem. Patent Literature 2 discloses a medicine packaging body provided with an entry column in which the usage and the like of a medicine are entered.

CITATION LIST

Patent Literature 1: Japanese Unexamined Patent Application Publication No. 2011-37527

Patent Literature 2: Japanese Unexamined Patent Application Publication No. 10-264964

SUMMARY OF THE INVENTION

In the PTP sheets in the combined state, the pockets contact a surface other than the pockets of the facing PTP sheet. Therefore, in the PTP sheets in the combined state, when the PTP sheets are pressurized in such a manner as to bring each surface facing the outside close to each other, the pocket is pressurized by the facing PTP sheet to be deformed or the medicine pressurized over the pocket breaks the aluminum foil in some cases. Or, when the medicine is a capsule agent or the like, the capsule agent is sometimes deformed by pressurization.

For example, when a patient carries a PTP sheet in which medicines are enclosed in a bag or the like, the surfaces facing the outside are pressurized by other goods, so that the above-described phenomenon occurs in the PTP sheets in the combined state. Or, when the PTP sheets are transported from a pharmaceutical company, the same phenomenon may occur.

The present invention has been made in view of the above-described circumstances. It is a first object of the present invention to provide a medicine packaging PTP sheet capable of protecting pockets from pressurization by external force in PTP sheets in a combined state.

With the medicine packaging body described in Patent Literature 2, entry columns 6*a* and 6*b* are located at a portion which is broken when taking out a content 4 (medicine) in a breakage prevention film 5. Therefore, there is a problem in that when a patient accidentally takes out the medicine before confirming the entry columns 6*a* and 6*b*, the patient cannot confirm the information entered in the entry columns 6*a* and 6*b*.

More specifically, it is a second object of the present invention to provide a medicine packaging PTP sheet on which information on a medicine can be easily entered and which allows a patient to confirm the entered contents before and after taking out the medicine.

Solution to Problem (1) For the first object described above, a medicine packaging PTP sheet according to the present invention has a first sheet in which a pocket capable of accommodating a medicine and a projecting convex portion each are projected from a first surface which is one of the front and back surfaces and a second sheet which is attached to a second surface opposite to the first surface of the first sheet and blocks an opening of the pocket. A first distance from the first surface to the projection end of the convex portion is longer than a second distance from the first surface to the projection end of the pocket.

According to the medicine packaging PTP sheet of such a configuration, each convex portion abuts on the first surface of the first sheet of the facing medicine packaging PTP sheet in the combined state. Since the facing medicine packaging PTP sheet is supported by the convex portions, a certain gap is formed between the medicine packaging PTP sheets. Since the first distance from the first surface to the projection end of the convex portions is longer than the second distance from the first surface to the projection end of the pocket, the pocket is maintained in a state where the pocket does not abuts on the facing medicine packaging PTP sheet.

When both the outer surfaces of the laminate of the PTP sheets are pressurized to each other in the combined state, the pressurization force is absorbed by the convex portions. Therefore, in the facing medicine packaging PTP sheet, the pocket is prevented from being pressurized.

(2) The projection end of the convex portion may be a plane parallel to the first surface.

Due to the fact that the projection end of the convex portion is a plane, the convex portion can stably support the facing medicine packaging PTP sheet.

(3) The projection end of the convex portion may have a concave depression in the center portion and may be a circular shape parallel to the first surface.

Due to the formation of the depression in the projection end of each convex portion, the convex portions can more stably support the facing medicine packaging PTP sheet. Moreover, due to the formation of the depression in the projection end of each convex portion, when a patient takes the medicine, the patient can distinguish the pocket in which the medicine is stored from the convex portions, so that the convenience is further improved.

(4) Two or more of the pockets may be provided and a pair of the convex portions may be provided on both the outside of one of the pockets.

Due to the fact that the pair of the convex portions are provided in each pocket, the gap between the medicine packaging PTP sheets can be certainly maintained in the circumference of the pocket.

(5) The medicine packaging PTP sheet may have a rectangular shape as viewed in a plane. Each pocket and each convex portion described above may be asymmetrical to any one of the pockets and any one of the convex portions with respect to a virtual straight line along the center in the longitudinal direction or the lateral direction of the rectangle.

According to such an arrangement of the pockets and the convex portions, even when the two medicine packaging PTP sheets are brought into the combined state in a state where the peripheries of the two PTP sheets are brought into agreement with each other, the pockets facing each other and the convex portions facing each other do not contact. Since the two medicine packaging PTP sheets can be brought into the combined state in a state where the peripheries of the two PTP sheets are brought into agreement with each other, the combined state is stabilized and the space saving of the medicine packaging PTP sheets can be achieved.

The rectangular shape in the present invention includes one in which the circumferential portions of the corners have a curved shape. More specifically, a medicine packaging PTP sheet whose four corners are rounded also belongs to the technical scope of the present invention. Any direction among the directions of two sides orthogonal to each other in the rectangle may be interpreted as the lateral direction or the longitudinal direction.

The state where the two pockets or convex portions are "asymmetrical" in the present invention refers to a state where when it is assumed that one pocket or convex portion is transferred to a symmetrical position, a region occupied by the transferred pocket or convex portion and a region occupied by the other pocket or convex portion are separated from each other in such a manner that the regions are not overlapped with each other.

(6) As viewed in a plane, all the pockets are disposed along the first direction, the pair of convex portions each are disposed along the second direction orthogonal to the first direction, and cutting portions each may be provided along the second direction.

(7) The first sheet has an entry region where characters or patterns can be entered at least with a pencil or a ball point pen in at least one part of the first surface, in which a region where the region occupied by each convex portion in the first sheet is symmetrically transferred with respect to the virtual straight line along the center of the longitudinal direction or the lateral direction of the rectangle may not be overlapped with the entry region.

In this configuration, since the entry regions are not provided at positions abutting on the convex portion in the combined state, a possibility that the characters and the patterns entered in the entry regions become faint or blurred is further reduced.

(8) For the second object, a medicine packaging PTP sheet according to the present invention has a translucent first sheet in which a pocket capable of accommodating a medicine is projected to a first surface which is one of the front and back surfaces and a second sheet which is attached to a second surface opposite to the first surface in the first sheet and blocks an opening of the pocket. Information which can be visually identified through the first sheet and which relates to the medicine is indicated on the surface to be attached to the first sheet in the second sheet and the first sheet has an entry region where characters or patterns can be entered at least with a pencil or a ball point pen in at least one part of the first surface.

Since the information which can be visually identified through the first sheet and which relates to the medicine is indicated on the surface to be attached to the first sheet in the second sheet, the patient can confirm general information on the medicine (for example, the name, the serial number, or the expiration date for use of the medicine). Moreover, the patient can confirm individual information of each patient (for example, dose time) on the medicine which a pharmacist enters in the entry regions.

Since the information can be visually identified from the first surface side of the first sheet, the information is easily confirmed.

The translucency of the first sheet in the present invention refers to a property which allows the first sheet to transmit visible light so that at least the in format ion indicated on the second sheet can be visually identified through the first sheet.

(9) The first sheet may be a molded article of a thermoplastic resin.

(10) The second sheet may be an aluminum film.

(11) The entry region may be one in which the first surface side of the first sheet is subjected to sandblast processing or emboss processing.

By the sandblast processing or the emboss processing, the entry region can be easily formed on the first surface side of the first sheet.

(12) The entry region may be one in which a material to be recorded in which characters or pattern can be entered at least with a pencil or a ball point pen is provided on the first surface side of the first sheet.

By the material to be recorded, the entry region can be easily formed on the first surface side of the first sheet.

(13) The material to be recorded may be a paint which adheres to the first surface side of the first sheet and which at least contains titanium oxide.

(14) The material to be recorded may be a third sheet which is attached to the first surface side of the first sheet with an adhesive.

(15) The entry regions of the first sheet constitute an entry column in which the dose time of the medicine is entered, and the dose time entered in the entry column and the characters indicated on the surface to be attached to the first sheet in the second sheet may constitute one sentence which indicates the dose time of the medicine.

(16) On the surface to be attached to the first sheet in the second sheet, "Month", "Day", and "Day of the week" each may be indicated with spaces. The entry regions may be disposed at least at positions corresponding to the spaces.

Due to the fact that "Month", "Day", and "Day of the week." are indicated beforehand, a pharmacist can immediately notice that the entry regions are regions where the dose time is to be entered. Moreover, the patient can immediately notice that the characters entered in the entry regions indicate the dose time.

(17) The medicine packaging PTP sheet has a rectangular shape as viewed in a plane, in which one side of the length or the width of the rectangle is 4 to 12 cm and the other side is 4 to 7 cm.

The medicine packaging PTP sheet of such a size is difficult for a patient to put into a mouth or to swallow. Therefore, a possibility that a patient erroneously swallows the medicine with the medicine packaging PTP sheet without taking out the medicine can be reduced.

The rectangular shape in the present invention includes one in which the circumference portions of the corners have a curved shape. More specifically, a medicine packaging PTP sheet whose four corners are rounded also belongs to the technical scope of the present invention. Any direction of the directions along two sides orthogonal to each other in the rectangle may be interpreted as the length or the width.

(18) The first sheet has a cutting portion which divides the medicine packaging PTP sheet into a pocket unit, one division obtained by dividing the medicine packaging PTP sheet has a rectangular shape as viewed in a plane, and one side of the length or the width of the rectangle is 4 to 12 cm and the other side is 4 to 7 cm.

Such a medicine packaging PTP sheet can reduce the possibility of accidental swallowing by a patient also after being divided into a medicine unit.

Advantageous Effects of Invention

According to the medicine packaging PTP sheet of the present invention, the pockets can be protected from pressurization by external force in the combined state. Moreover, the information on the medicine can be easily entered and a patient can confirm the entered contents before and after taking out the medicine.

BRIEF DESCRIPTION OF THE DRAWINGS

FIGS. 1(A) and 1(B) are perspective view of the appearance of a PTP sheet divided into a cell unit, in which FIG. 1(A) illustrates a state where a medicine is not accommodated and FIG. 1(B) illustrates a state where the medicine is accommodated.

FIGS. 4(A) to 4(B) are views illustrated regions where characters and patterns are indicated on the second sheet, in which FIG. 4(A) illustrates the upper surface and FIG. 4(B) illustrates the lower surface.

FIGS. 5(A) to 5(B) are views illustrating a state where two PTP sheets are brought into a combined state, in which FIG. 5(A) is a plan view and FIG. 5(B) is a cross sectional view taken along the B-B line of FIG. 5(A).

FIGS. 6(A) to 6(B) are views illustrating a convex portion according to Modification 1 of the PTP sheet, in which FIG. 6(A) is a plan view and FIG. 6(B) is a cross sectional view taken along the B-B line of FIG. 6(A).

FIGS. 8(A) to 8(B) are plane views illustrating different arrangement manners of pockets and convex portions, in which FIG. 8(A) illustrates the PTP sheets which are not in a combined state, FIG. 8(B) illustrates a state where the PTP sheet is reversed in such a manner as to be reversed in a longitudinal direction and then brought into a combined state with the PTP sheet, and FIG. 8(C) illustrates a state where the PTP sheet is reversed in such a manner as to be reversed in a horizontal direction and then brought into a combined state with the PTP sheet.

DESCRIPTION OF THE PREFERRED EMBODIMENTS

Figure 1:
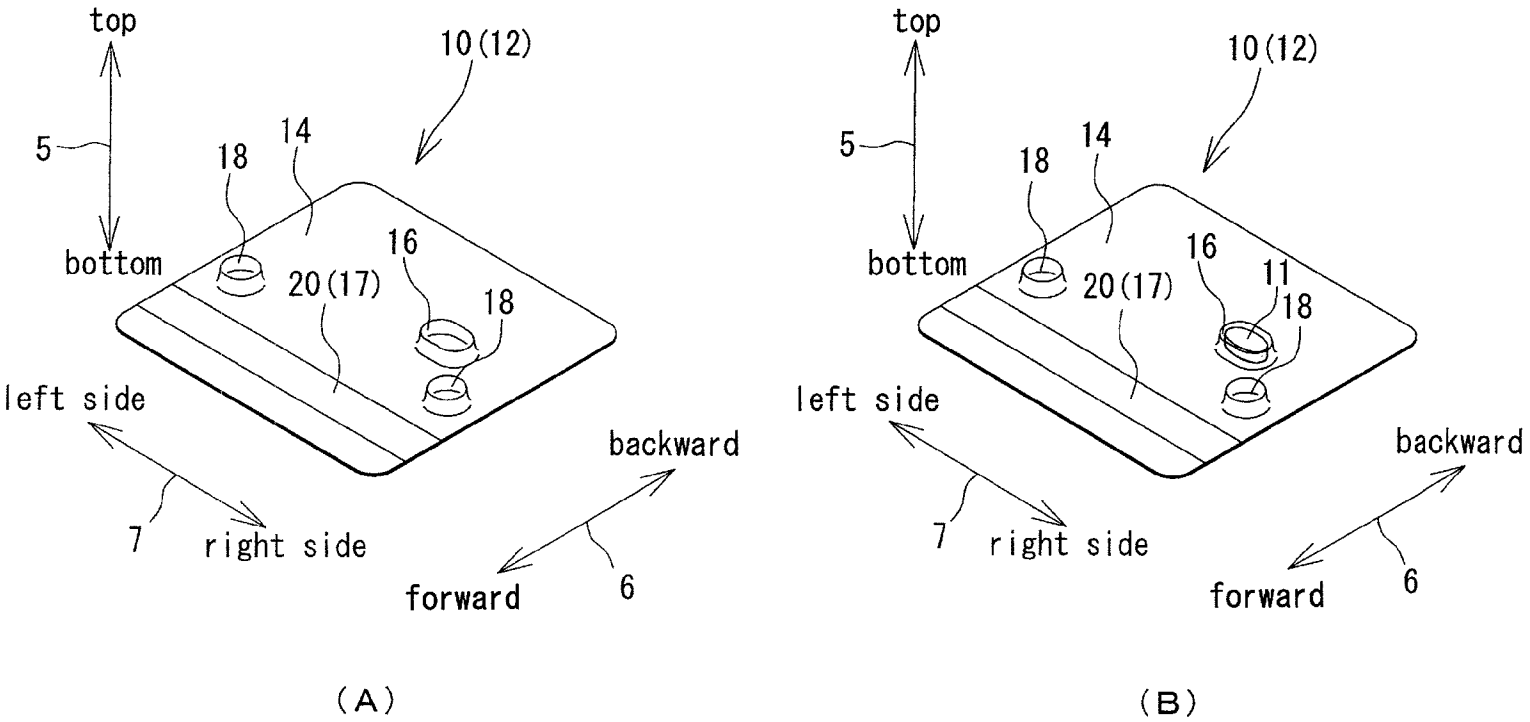

Hereinafter, embodiments of the present invention are described with reference to the drawings as appropriate. The embodiment described below merely describes one example of the present invention. It is a matter of course that the embodiments of the present invention can be altered as appropriate insofar as the gist of the present invention is not altered. In the following description, a vertical direction 5 is defined based on the top and the bottom, a longitudinal direction 6 is defined as a direction perpendicular to the vertical direction 5, and a horizontal direction 7 is defined as a direction perpendicular to the vertical direction 5 and the longitudinal direction 6. Herein, the longitudinal direction 6 is one example of the first direction of the present invention and the horizontal direction 7 is one example of the second direction of the present invention.

As illustrated in FIGS. 1(A) and 1(B), the PTP sheet 10 is a rectangular sheet as viewed in a plane. As illustrated in FIG. 1(B), a tablet or a capsule agent (hereinafter collectively referred to as a medicine 11) is sealed in the PTP sheet 10. In the PTP sheet 10 of an example of FIG. 2, two cells 12 (one example of one division of the present invention) which is a division for sealing one medicine 11 are arranged in the longitudinal directions 6. More specifically, two medicines 11 in total are sealed in the PTP sheet 10 of FIG. 2.

On the boundary of the cells 12, a slit 13 (one example of a cutting portion of the present invention) is formed. The PTP sheet 10 can be divided into a single cell 12 by being bent or separated by cutting along the slit 13 by the hand of a pharmacist or a patient. The size in the longitudinal direction 6 of the cell 12 is 4 to 12 cm and preferably 5 to 6 cm. This embodiment describes an example of 5.5 cm. The size in the horizontal direction 7 is 4 to 7 cm and preferably 5.5 to 6.5 cm. This embodiment describes an example of 5.8 cm. In the following description, a group of two or more of the cells 12 which are not divided and the single cell 12 after divided each are referred to as the PTP sheet 10.

The PTP sheet 10 is one in which a first sheet 14 obtained by molding polypropylene and a second sheet 15 (FIG. 3) which is an aluminum film are bonded to each other. A medicine 11 is accommodated in a pocket 16 formed in the first sheet 14. The opening of the pocket 16 is blocked by the second sheet 15. When the pocket 16 of the first sheet 14 is pressurized by a patient's fingertip, the pocket 16 is elastically deformed, so that the medicine 11 is pressed against the second sheet 15. The second sheet 15 is pressed by the medicine 11 to be broken, so that the medicine 11 is taken out from the pocket 16 through the opening.

When stored or transported or carried by a patient, the PTP sheets 10 are laminated to each other in such a manner that the first sheets 14 face each other to be brought into a combined state. The combined state refers to a state where the pockets 16 of one PTP sheet 10 of the two PTP sheets 10 enters the gap between the pockets 16 of the other PTP sheet 10, so that the pockets 16 are alternately disposed. Convex portions 18 are projected from the same surface as the surface on which the pockets 16 are provided of the first sheet 14. In the PTP sheets 10 in the combined state, when the convex portions 18 support the facing PTP sheet 10, so that the pockets 16 are maintained in a state where the pockets 16 do not contact the facing PTP sheet 10.

Entry regions 17 are formed on the surface on an upper portion of the first sheet 14. The entry regions 17 are regions where characters are entered with pens and pencils, such as a pencil or a ball point pen. The entry regions 17 are provided in each cell 12. A pharmacist enters the information on the medicine 11, for example, the time when a patient takes the medicine 11, in the entry regions 17. The patient can confirm the entry of the entry regions 17 and can take the medicine 11 with the correct usage.

Hereinafter, each constituent member of the PTP sheet 10 is described in detail. In the following description, although the expressions of the upper surface and the lower surface of each sheet are sometimes used, these expressions are based on the direction of the PTP sheet 10 in FIGS. 1 and 2. The upper surface (surface to which the pockets 16 are projected) of the first sheet 14 is equivalent to the first surface of the present invention and the lower surface (surface attached to the second sheet 15) is equivalent to the second surface of the present invention.

Figure 2:
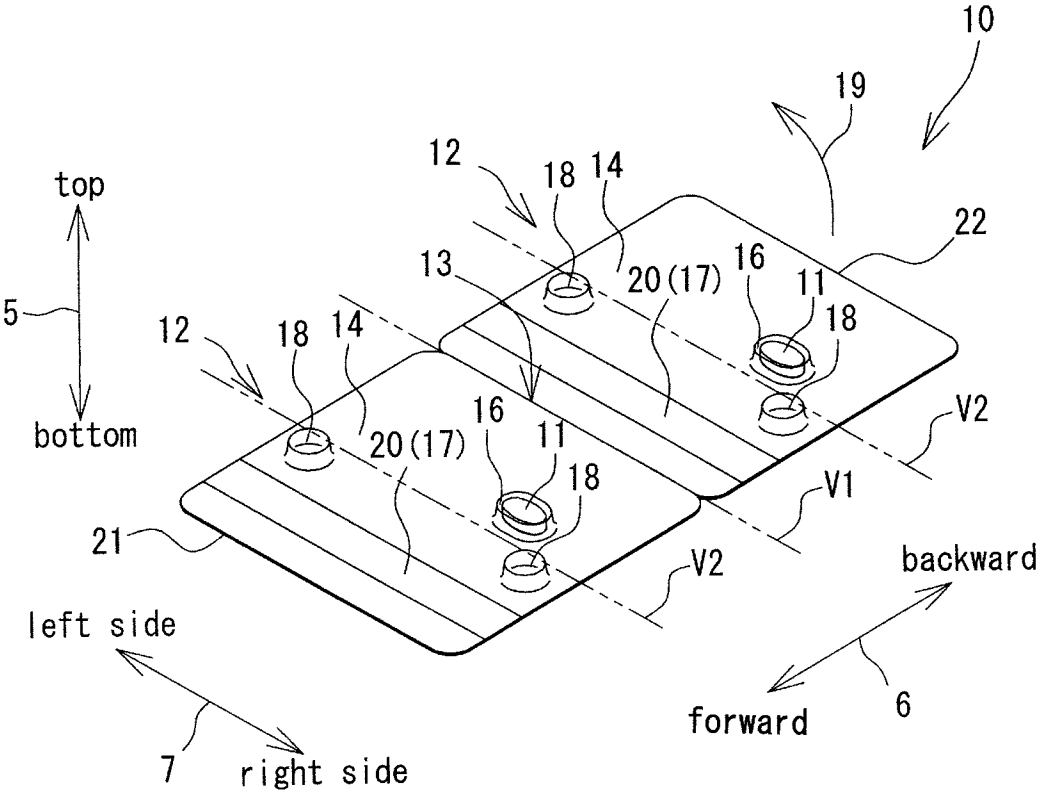
FIG. 2 is a perspective view of the appearance the PTP sheet in which two cells are combined.
Figure 3:
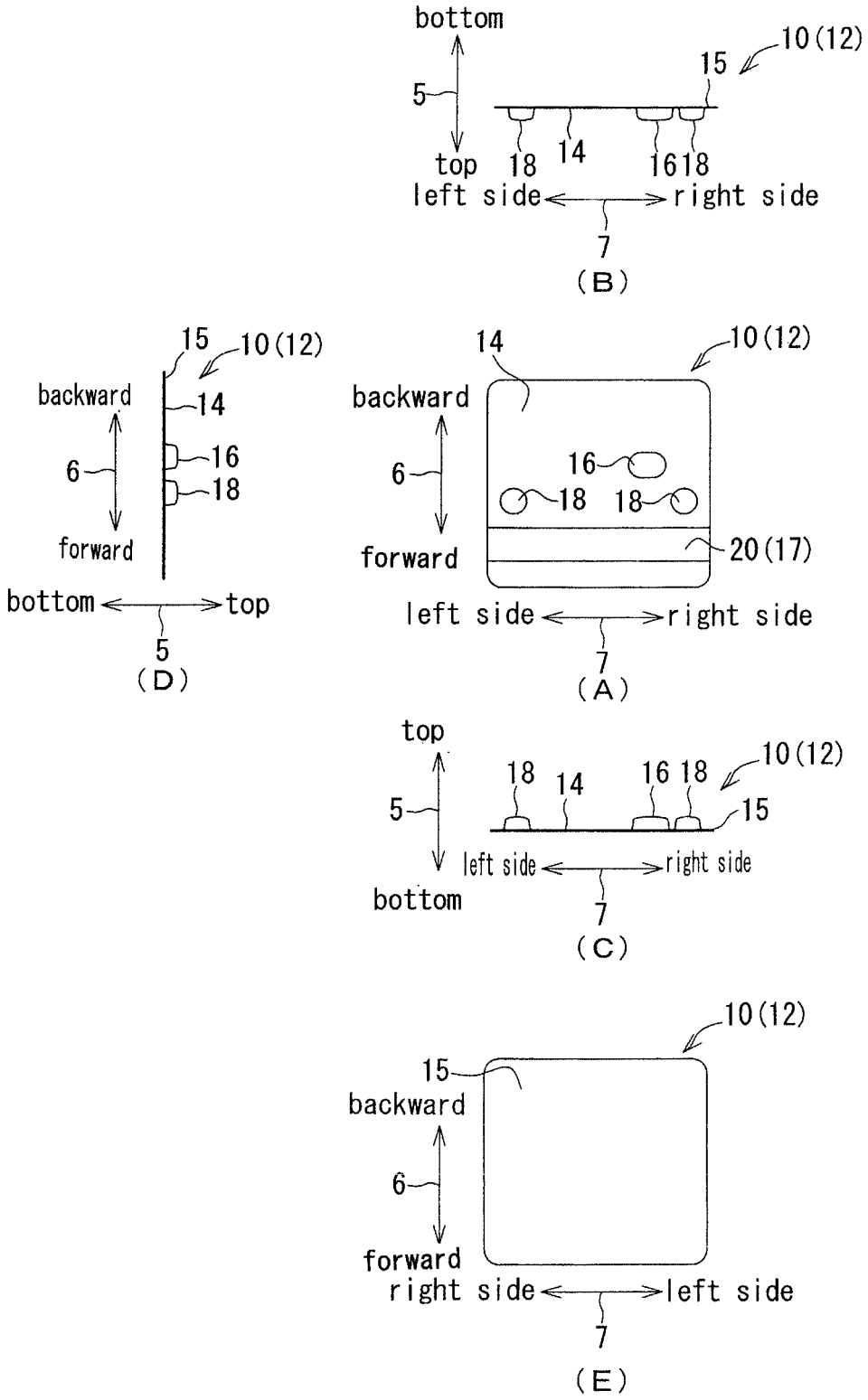
FIGS. 3(A) to 3(E) are views illustrating the PTP sheet divided into the cell unit by a third angle projection method.
Figure 4:
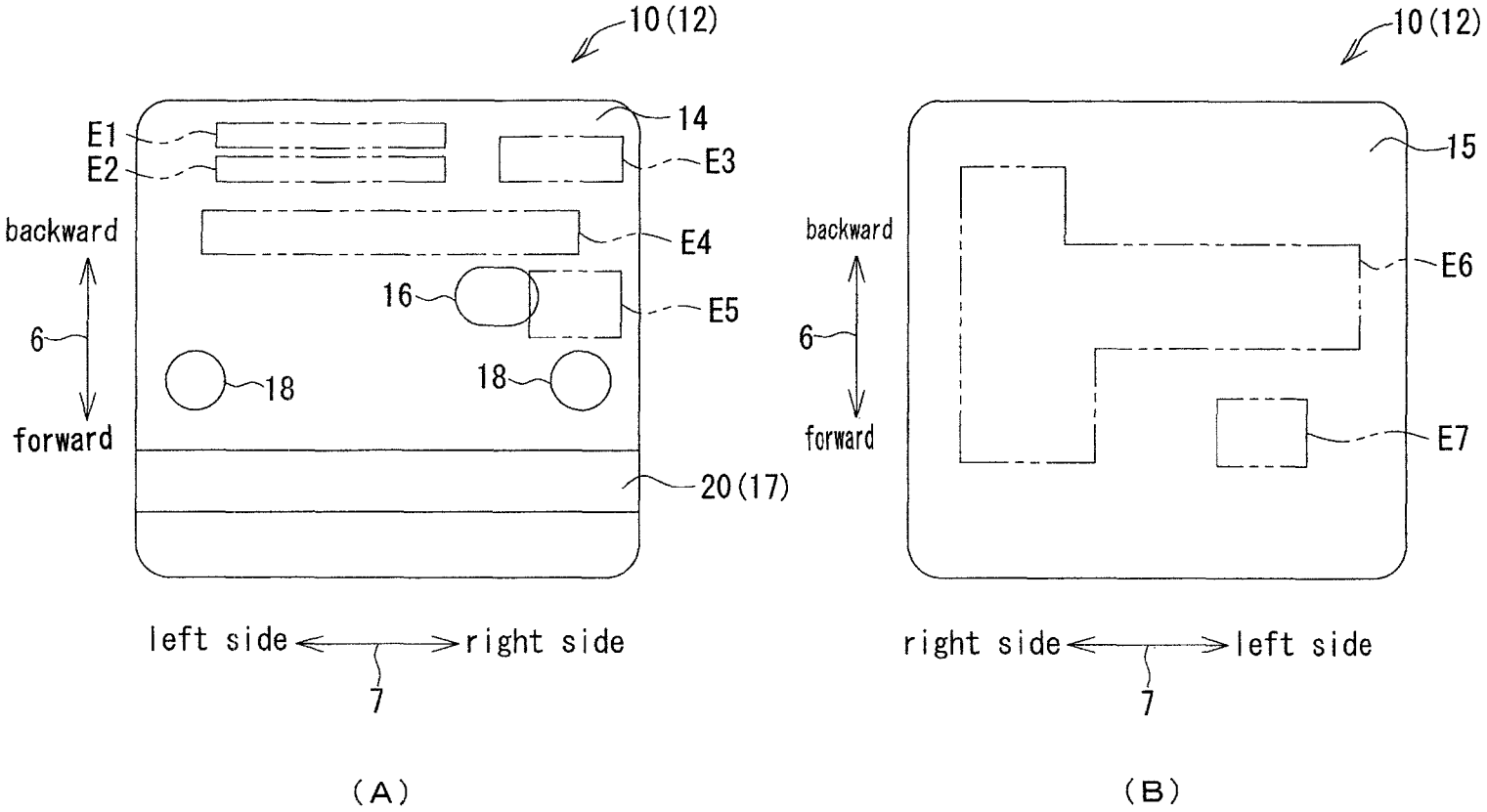

The first sheet 14 illustrated in FIGS. 1 to 3 is obtained by vacuum molding a polypropylene (PP) sheet which is a thermoplastic resin. The first sheet 14 has a certain translucency. Thus, a patient can visually identify characters and patterns indicated on the second sheet 15 described later through the first sheet 14.

As the raw material of the first sheet 14, another resin may be used insofar as the resin has translucency which allows a patient to visually identify characters patterns indicated on the second sheet 15 and the resin which can be elastically deformed by pressurization with a fingertip. For example, as the raw material of the first sheet 14, polyvinyl chloride (PVC), polyethylene terephthalate (PET), or cyclic polyolefin may be used. Or, the first sheet 14 may be constituted by coating a resin sheet with a thin film. Or, the first sheet 14 may be constituted by laminating two or more kinds of resin layers.

As illustrated in FIG. 2, the first sheet 14 has an almost rectangular shape in a state where two cells 12 are combined. Portions equivalent to the four corners of each cell 12 are cut into a curved shape. The cutting is performed for preventing a patient from being damaged on the hand or the like by the corners of the cell 12.

The slit 13 is formed on the boundary of the cells 12 as illustrated in FIG. 2. The slit 13 is an almost V shaped slot formed in the upper surface of the first sheet 14. The depth of the slit 13 is somewhat larger than the half of the thickness of the first sheet 14. A perforation in which small holes are periodically formed may be provided in place of the slit 13. A slot and a perforation may be superimposed in place of the slit 13. In the manufacturing stage of the PTP sheet 10, roller shaped edges relatively move in a state of pressurizing the upper surface of the first sheet 14. Thus, the slit 13 is formed in the first sheet 14.

The divided cells 12 have a rectangular shape as viewed in a plane. The size in the longitudinal direction 6 of the cell 12 is 5.5 cm and the size in the horizontal direction 7 thereof is 5.8 cm. This size can prevent accidental swallowing of a patient. The size of each cell 12 is not limited thereto. For example, the cell 12 may have a square shape as viewed in a plane, in which the size in the longitudinal direction 6 and the size in the horizontal direction 7 are equal to each other. Or, the cell 12 may be one in which the size in the longitudinal direction 6 is larger than the size in the horizontal direction 7.

In the first sheet 14, one pocket 16 is provided in each cell 12. The pocket 16 is provided slightly backward relative to the center in the longitudinal direction 6 and slightly on the right side relative to the center in the horizontal direction 7 in each cell 12.

The pocket 16 is molded into a dome shape in such a manner that the first sheet 14 is projected upward. More specifically, in the pocket 16, the upper surface of the first sheet 14 is projected upward and the lower surface is depressed upward. An internal space in which the medicine 11 is accommodated is formed in the depressed portion. An opening which is continuous from the internal space to the outside of the pocket 16 opens in the lower surface side of the first sheet 14. The size of the pocket 16 is set in such a manner that the medicine 11 can be completely accommodated and is changed as appropriate according to the size of the medicine 11.

In the first sheet 14, two convex portions 18 are provided in each cell 12. The two convex portions 18 are provided slightly forward relative to the pocket 16 in each cell 12. The two convex portions 18 are separated to both the outside in the horizontal direction 7 relative to the pocket 16 and form one pair.

Figure 5:
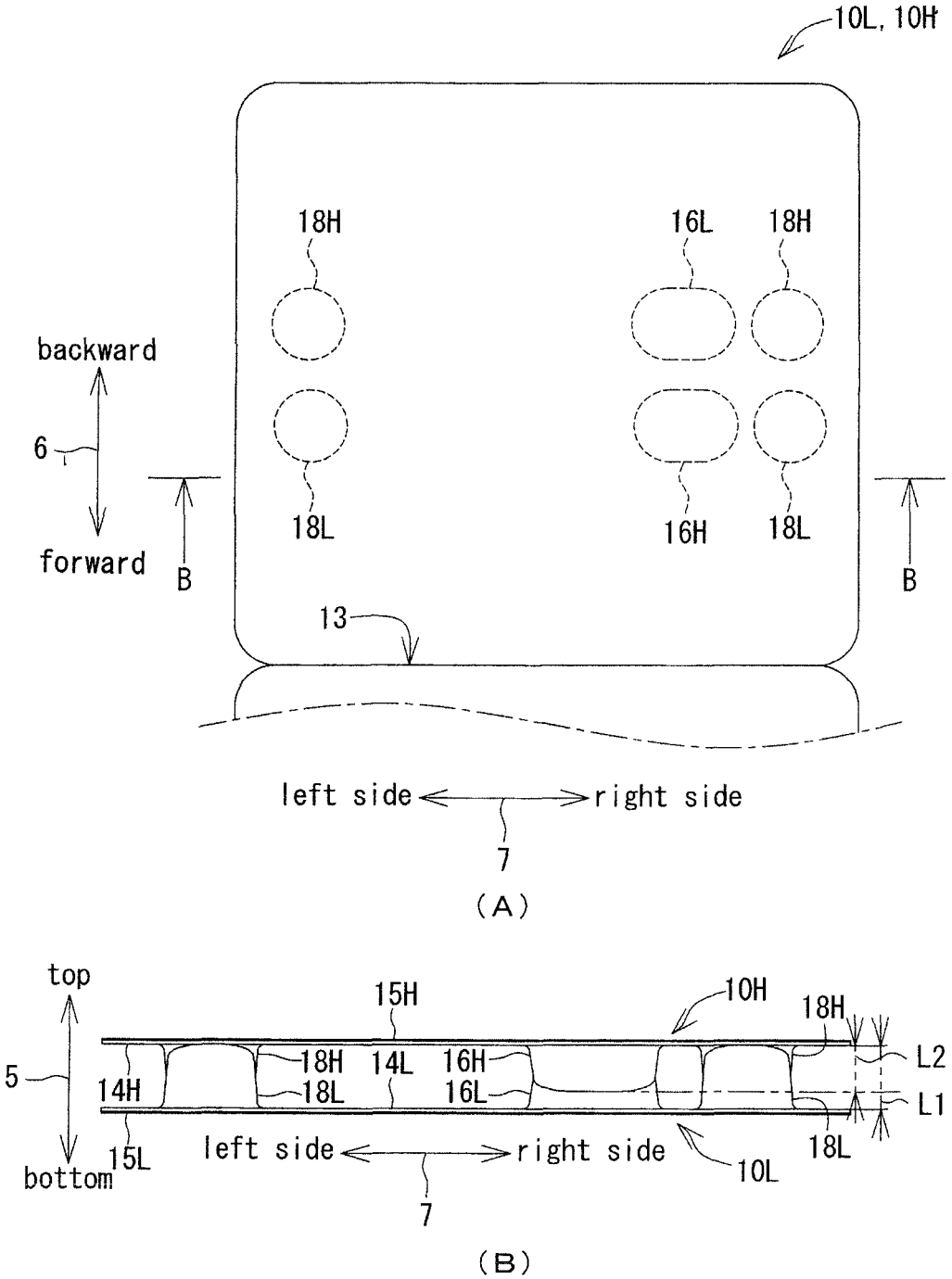
Figure 7:
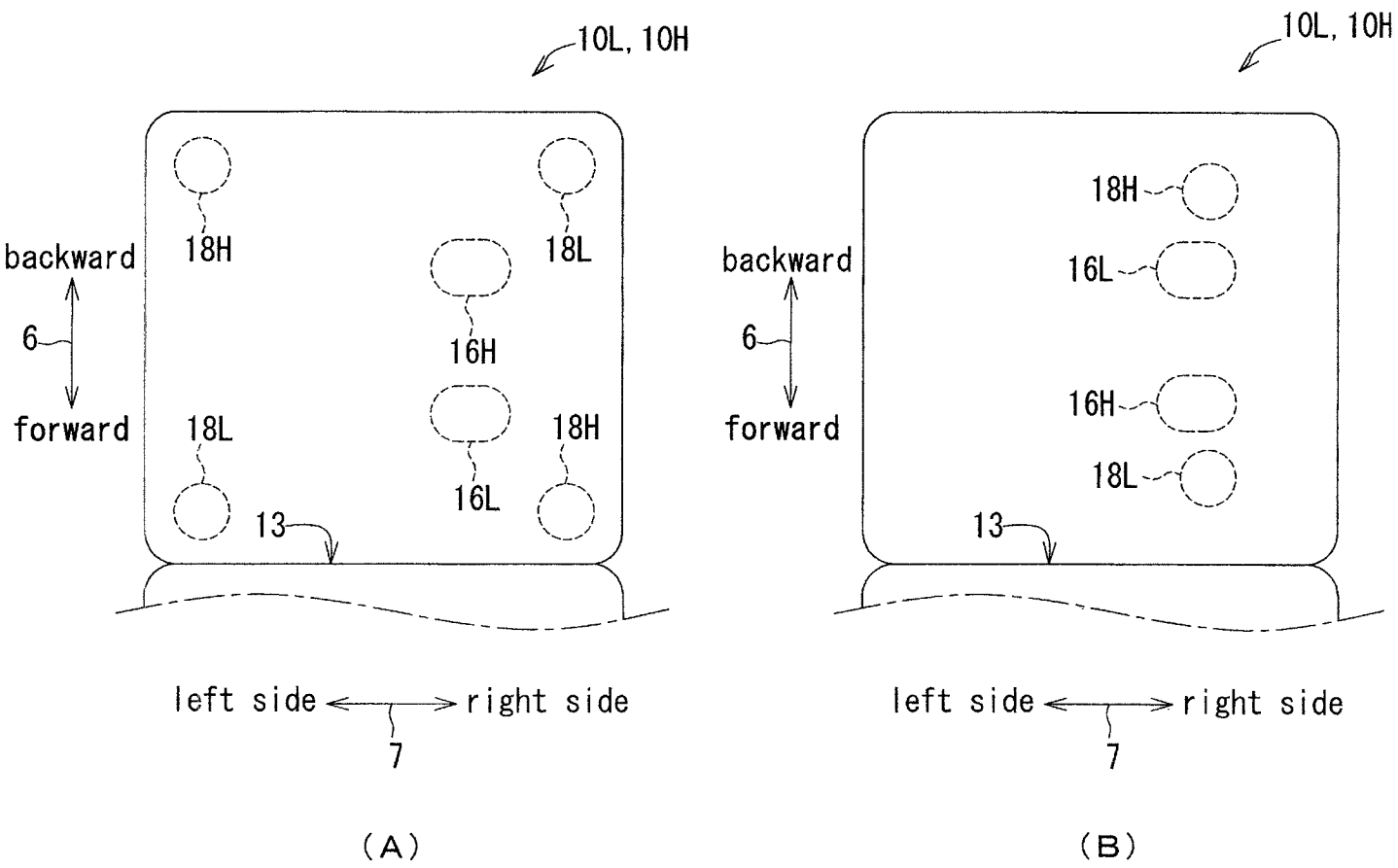
FIGS. 7(A) to 7(B) are plane views illustrating different arrangement manners of pockets and convex portions in a combined state, in which FIG. 7(A) relates to Modification 2 of the embodiment of the present invention and FIG. 7(B) relates to Modification 3 thereof.
Figure 8:
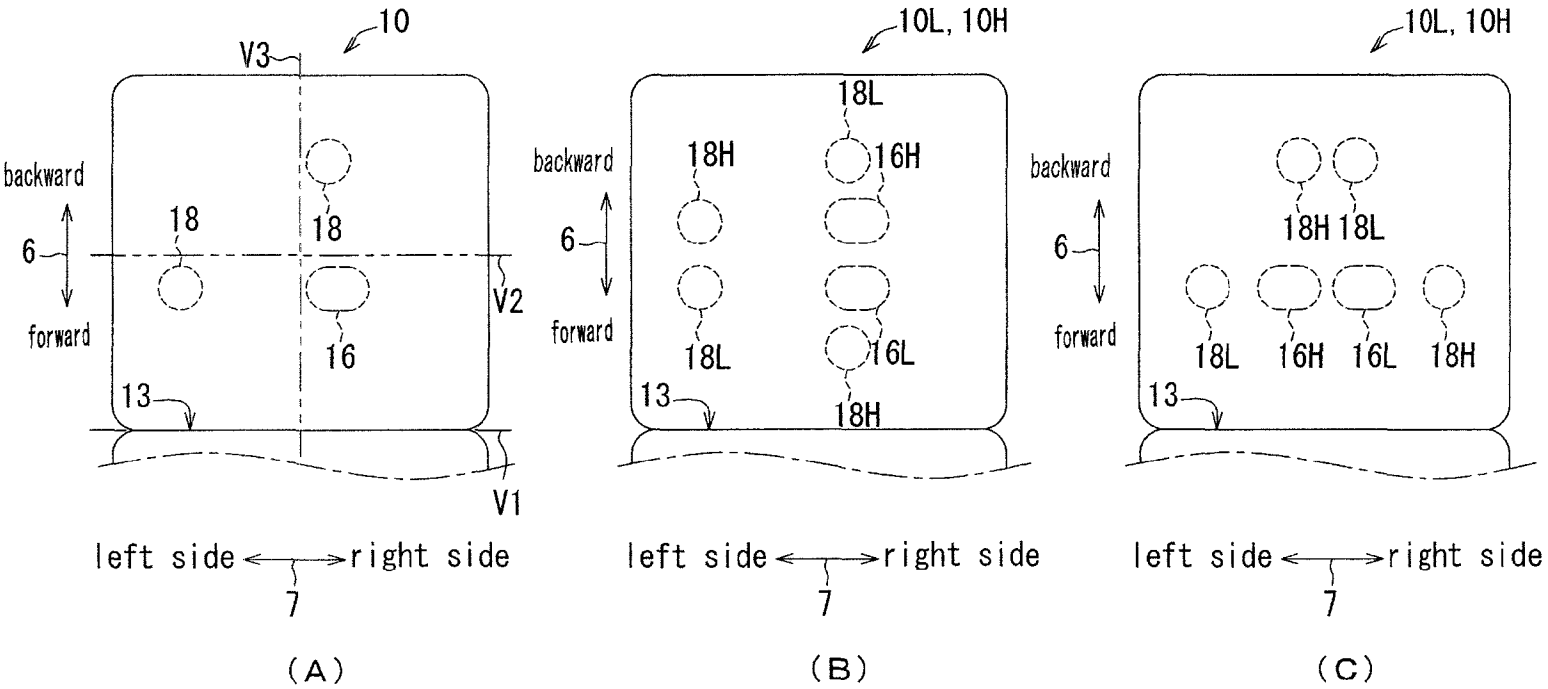

The convex portion 18 is one in which the first sheet 14 is molded into a dome shape similarly as the pocket 16. On the other hand, the medicine 11 is not accommodated in the internal space of the convex portion 18 as a difference from the pocket 16. The projection end of the convex portion 18 is molded into a shape which is a circular shape as viewed in a plane and in which the center portion expands slightly upward. As illustrated in FIG. 5(B), the convex portions 18 support the facing PTP sheet 10 in the combined state of the PTP sheets 10. The details in the combined state are described later. In FIGS. 5, 7, and 8, in order to distinguish the two PTP sheets 10 in the combined state, "L" is given to the end of the reference numeral relative to the lower PTP sheet 10 and "H" is given to the end of the reference numeral relative to the upper PTP sheet 10.

A distance L1 (FIG. 5(B), One example of the first distance of the present invention) from the upper surface of the first sheet 14 to the projection end of the convex portion 18 is longer than a distance L2 (FIG. 5(B), One example of the second distance of the present invention) from the upper surface of the first sheet 14 to the projection end of the pocket 16. Since the distance L2 is changed as appropriate according to the size of the sealed medicine 11, the distance L1 is also changed as appropriate according to the distance L2. When the medicine 11 is a common tablet, the distance L2 is 5 to 8 mm and the distance L1 is 1 to 3 mm longer than the distance L2. In this embodiment, the distance L1 is 7 mm and the distance L2 is 5 mm.

As illustrated in FIG. 1 to FIG. 4, a seal 20 (One example of Material to be recorded of the present invention and one example of a third sheet of the present invention) is attached farther forward relative to the convex portion 18. The seal 20 is a paper sheet cat into a belt shape. An adhesive is applied to one side of the front and back surfaces of the seal 20. The seal 20 is attached to the upper surface of the first sheet 14 with the adhesive while defining the horizontal direction 7 as the longitudinal direction. The surface to which the adhesive is not applied of the front and back surfaces of the seal 20 is exposed upward. On the surface, a pharmacist can enter the information on the medicine 11 with pens and pencils, such as a pencil and a ball point pen. A region where the seal 20 is attached on the upper surface of the first sheet 14 is the entry region 17 described above.

In the PTP sheet 10 before being divided as illustrated in FIG. 2, all the pockets 16 and the convex portions 18 are asymmetrically disposed with respect to a virtual straight line V1 along the center of the PIP sheet 10 in the longitudinal direction 6. More specifically, any pocket 16 and any convex portion 18 are not provided at a position symmetrical, to each pocket 16 and each convex portion 18 with respect to the virtual straight line V1. The seal 20 is disposed at a position asymmetrical to the convex portion 18 with respect to the virtual straight line V1. More specifically, the seal 20 is not provided at a position symmetrical to the convex portion 18 in the longitudinal direction 6. Similarly, all the pockets 16 and the convex portions 18 are asymmetrically disposed with respect to a virtual straight line V2 along the center of the cell 12 in the longitudinal direction 6 in each cell 12. The seal 20 is disposed at a position asymmetrical to the convex portion 18 with respect to the virtual straight line V2. The reason therefor is described later. Herein, virtual straight lines V1 to V3 also including the virtual straight line V3 described later are one example of virtual straight lines of the present invention.

The second sheet 15 (FIGS. 3 and 4) is an aluminum film. The second sheet 15 is attached to the lower surface side of the first sheet 14 in a state where the medicine 11 is accommodated in the pocket 16. The opening of the pocket 16 is closed by the second sheet 15, and the medicine 11 is enclosed inside the pocket 16.

The thickness of the second sheet 15 is set to a thickness in such a manner that the second sheet 15 is broken by the pressurization force from the medicine 11 when a patient pressurizes the medicine 11 over the pocket 16. In this embodiment, the thickness of the second sheet 15 is 20 μm. The thickness of the second sheet 15 may be changed as appropriate according to the hardness of the medicine 11, for example, whether the medicine is a tablet or a capsule agent. Materials other than an aluminum film may be used as the material of the second sheet 15 insofar as the materials satisfy the above-described requirements. For example, the second sheet 15 may be a film of metal other than aluminum and may be a film containing an alloy of aluminum and another metal. Other chemical materials may be used for the second sheet 15 insofar as the airtightness of the pocket 16 can be secured.

The first sheet 14 and the second sheet 15 are bonded to each other under heating in a state where the medicine 11 is accommodated in the pocket 16. In that case, due to the fact that the lower surface of the first sheet 14 which is half melted by the heat is solidified, the first sheet 14 and the second sheet 15 are melted and bonded.

Although not illustrated in the figures, characters and patterns which can be visually identified by a pharmacist and a patient are indicated on each of the upper surface and the lower surface of the second sheet 15. The characters and patterns indicated on the upper surface of the second sheet 15 can be visually identified from the upper surface of the first sheet 14 through the first sheet 14.

As illustrated in FIG. 4(A), in a region E1 on the upper surface of the second sheet 15, the serial number of the medicine 11 is entered. In a region E2, the expiration date for use of the medicine 11 is indicated. In a region E3, the weight of the medicine 11 is entered. In a region E4, the name of the medicine 11 is entered. In a region E5, a pattern which shows a method of taking out the medicine 11 from the PTP sheet 10 is entered.

Moreover, as illustrated in FIG. 4(B), on the lower surface of the second sheet 15, the usage of the medicine 11 common to all the patients is indicated in a region E6. For example, directions, such as "Take one tablet before meal when waking up in the morning", "Take medicine with a glass of water without chewing, "You may drink something other than water or lie down 30 minutes after taking medicine", and "When you forgot to take medicine, please take one tablet on the morning of the day following the day when you noticed", are indicated. In a region E7, a pattern which shows a method for taking out the medicine 11 from the PTP sheet 10 is indicated similarly as in the region E3.

The characters and pattern indicated on the second sheet 15 are printed by applying ink or spraying ink by an ink jet method. Since the first sheet 14 and the second sheet 15 are bonded under heating, a liquid thermosetting ink with nigh adhesive strength with aluminum is used as the ink. For example, an ink is used in which a modified olefin resin is used as a main resin and toluene or methyl ethyl ketone is used as a dilution solvent.

Hereinafter, the combined state of the PTP sheets 10 is described with reference to FIGS. 5(A) and 5(B). The two PTP sheets 10L and 10H are laminated to each other in such a manner that the first sheet 14L and 14H face each other. In the two PTP sheets 10L and 10H, front ends 21 and back ends 22 illustrated in FIG. 2 are brought into agreement with each other in the longitudinal direction 6. More specifically, the PTP sheet 10L is in the state of FIG. 2 and the PTP sheet 10H is reversed in such a manner that the longitudinal direction 6 is reversed from the state of FIG. 2. Then, the PTP sheet 10H is placed over the PTP sheet 10L.

As described above, in each PTP sheet 10, the pockets 16 and the convex portions 18 are asymmetrically disposed with respect to the virtual straight lines V1 and V2. Therefore, in the combined state, the pockets 16L and 16H and the convex portions 18L and 18H which face each other are in the position relationship where the pockets and the convex portions do not contact each other.

In FIG. 5(A), the convex portions 18L are disposed on both the outside in the horizontal direction 7 relative to the pocket 16H. Moreover, the convex portions 18H are disposed on both the outside in the horizontal direction 7 relative to the pocket 16L. The convex portions 13L and 18H abut on the first sheets 14L and 14H of the facing PTP sheets 10L and 10H, respectively, and support the same. Thus, the gap of the distance L1 (FIG. 5(B)) is maintained between the first sheets 14L and 14H. Since the distance L2 is shorter than the distance L1, the pockets 16L and 16H are maintained in such a manner as not to contact the facing PTP sheets 10L and 10H by the gap. The pockets 16L and 16H are disposed inside the convex portions 18L and 18H, respectively, in the horizontal direction 7. Therefore, also when the PTP sheets 10L and 10H are bent, the gap is easily maintained around the pockets 16L and 16H.

When the two PTP sheets 10L and 10H are relatively shifted in the horizontal direction 7 or the longitudinal direction 6 in the combined state, the pockets 16L and 16H or the convex portions 18L and 18H contact each other to prevent the movement. Hereinafter, the details are described. When the PTP sheet 10H is slightly shifted backward relative to the PTP sheet 10L, the pockets 16L and 16H contact each other to thereby prevent the movement equal to or greater than the shift. When the PTP sheet 10H is slightly shifted forward relative to the PTP sheet 10L, the pockets 16L and 16H contact each other to thereby prevent the movement equal to or greater than the shift. When the PTP sheet 10H is slightly shifted to the left side relative to the PTP sheet 10L, the pocket 16L contacts the convex portion 18H on the right side to thereby prevent the movement equal to or greater than the shift. When the PTP sheet 10H is slightly shifted to the right side relative to the PTP sheet 10L, the pocket 16H contacts the convex portion 18L on the right side to thereby prevent the movement equal to or greater than the shift. More specifically, the range where the two PTP sheets 10L and 10H can be relatively shifted in the horizontal direction 7 and the longitudinal direction 6 is limited to a narrow range.

As described above, in each PTP sheet 10, the seal 20 is disposed asymmetrically to the convex portion 18 with respect to the virtual straight lines V1 and V2. Therefore, in the combined state, the projection ends of the convex portions 18L and 18H abut on the PTP sheets 10L and 10H at positions different from the positions of seals 20L and 20H.

In the PTP sheet 10 before being divided illustrated in FIG. 2, the cell 12 at the back side can also be bent in a direction 19 with the slit 13 as a bending line. In the state where the cell 12 is bent, the same state as the combined state described above is realized by the front cell 12 and the back cell 12. The bent PTP sheet 10 is maintained in a state where the pocket 16 does not contact the facing cell 12 similarly as in the combined state.

The PTP sheet 10 according to this embodiment can protect the pockets 16 from the pressurization by external force because, in the PTP sheets 10 in the combined state, the pockets 16 are maintained in a state where the pockets 16 do not contact the facing PTP sheet 10.

In the PTP sheets 10 in the combined state, the convex portions 18 are disposed on both the outside in the horizontal direction 7 with respect to the pocket 16. Therefore, the gap between the first sheets 14 is easily maintained in the circumference of the pocket 15. More specifically, also when the PTP sheets 10 are bent, a possibility that the pocket 16 contacts the facing PTP sheet 10 is reduced.

Since the pockets 16 and the convex portions 18 are asymmetrically disposed with respect to the virtual straight lines V1 and V2, the pockets 16 and the convex portions 18 which face each other do not contact each other when the PIP sheets 10 are brought into the combined state in such a manner that the front ends 21 and the back ends 22 of the two PTP sheets 10 are brought into agreement with each other. More specifically, the two PTP sheets 10 can be brought into the combined state without relatively shifting the sheets in the longitudinal direction 6. Thus, the combined state is stabilized and simultaneously the state can contribute also to space saving.

Moreover, since the convex portions 18 support the facing PTP sheet 10 in the PTP sheets 10 in the combined state, the sheets are maintained in a state where the seal 20 does not contact the facing first surface 14. Furthermore, since the seal 20 is disposed at a position asymmetrical to the convex portions 18 with respect to the virtual straight lines V1 and V2, the projection ends of the convex portions 18 abut on the facing PTP sheet 10 at a position different from the position of the seal 20. Therefore, the seal 20 does not contact the facing convex portions 18. Therefore, the characters and patterns indicated on the seal 20 can be prevented from becoming faint or blurred.

Moreover, since the range where the PTP sheets 10 in the combined state can be relatively shifted in the horizontal direction 7 and the longitudinal direction 6 is limited, the combined state is further stabilized. In particular, also when a plurality of pairs of the PTP sheets 10 in the combined state are laminated, the combined state is difficult to break.

Since the PTP sheet 10 can be bent with the slit 13 as the bending line, it becomes easy for a patient to carry the same. Moreover, the PTP sheet 10 in the bent state is also maintained in the state where the pockets 16 do not contact the facing cell 12, and therefore the pockets 16 can be protected from the pressurization by external force.

Moreover, since the entry regions 17 are formed on the upper surface of the first sheet 14, a pharmacist can enter individual information of each patient on the medicine 11, such as the time of taking the medicine 11.

Moreover, a patient can properly take the medicine 11 based on the individual information of each patient. For example, in the case of the medicine 11 which is to be taken every two weeks or every two months, the patient can properly take the medicine 11 as directed by the pharmacist.

Moreover, since the entry regions 17 are secured forward relative to the pockets 16 or the convex portions 18, a pharmacist can easily perform entering in a state where the pharmacist presses a portion on the back side relative to the entry regions 17.

Moreover, since the shape and the name of the medicine 11 can be confirmed from the same surface as the surface on which the entry regions 17 are formed, a risk that a pharmacist enters incorrect information on the medicine 11 is reduced. Moreover, since a patient can confirm the time of taking the medicine 11 and the like simultaneously with confirming the shape and the name of the medicine 11, a risk of taking the medicine 11 with an incorrect usage is reduced.

Moreover, the entry regions 17 are formed on not the second sheet 15 but the first sheet 14. Therefore, even after a patient takes out the medicine 11 and the second sheet 15 is broken, the patient can confirm the information on the medicine 11 entered in the entry regions 17.

Moreover, since the entry regions 17 are formed with the seal 20, the PTP sheet 10 is manufactured at low cost.

Modification 1

Figure 6:
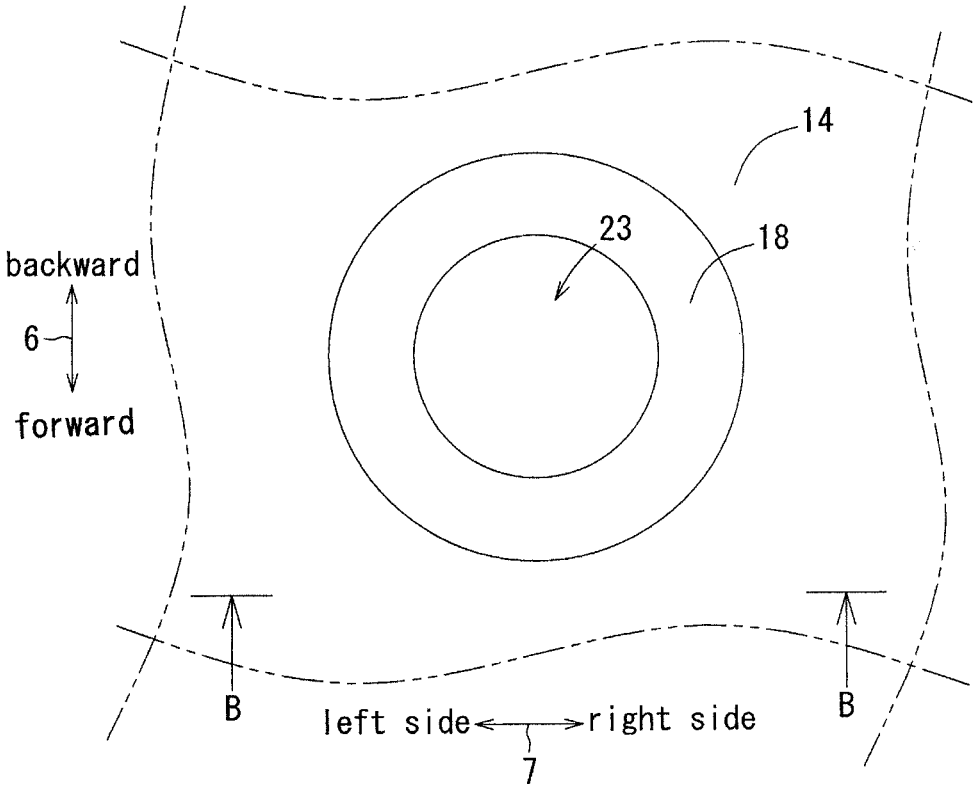
Figure 6:
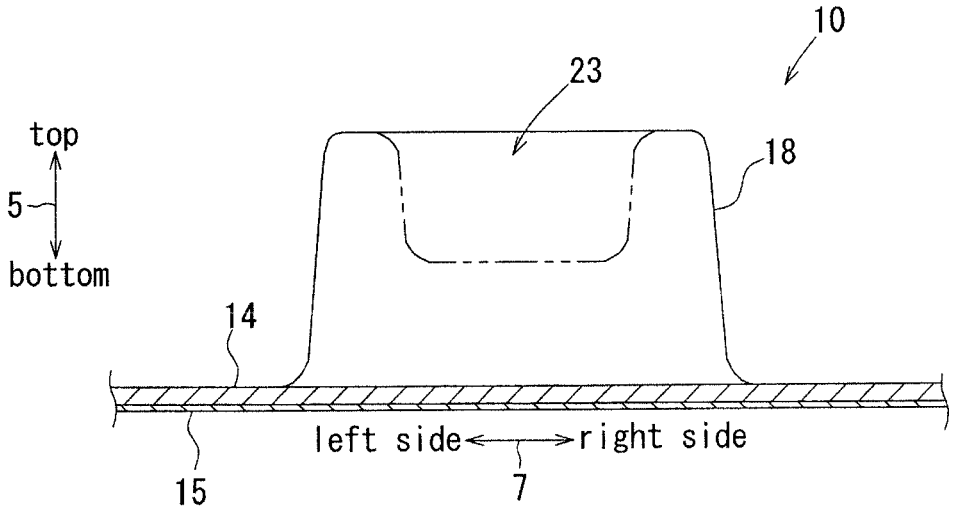

In the embodiment described above, the projection end of the convex portion 18 was molded into a shape which was circular as viewed in a plane and whose center portion slightly expands upward. On the other hand, the projection end of the convex portion 18 may be molded into a planar shape parallel to the upper surface of the first sheet 14 in order to increase the area of abutting on the facing first sheet 14. Or, the projection end of the convex portion 18 may have a ring shape having a depression 23 at the center of the circle (one example of the depression of the present invention) as illustrated in FIGS. 6(A) and 6(B). The convex portion 18 abuts on the first sheet 14 of the facing PTP sheet 10 along the ring. In the shape of such a projection end, the force in which the convex portions 18 support the facing PTP sheet 10 is received by the ring portion which is a peripheral portion of the depression 23. Since the peripheral portion of the depression 23 is more difficult to be elastically deformed by the pressurization force than in the center portion, the PTP sheet 10 can be stably supported. Due to the fact that the depression 23 is formed on the projection end of the convex portion 18, when a patient takes the medicine 11, the patient can distinguish the pocket 16 in which the medicine 11 is stored from the convex portion 18, and thus the convenience can be further increased.

Modification 2

The arrangement of the pockets 16 and the convex portions 18 in the embodiment described above is one example and may be changed as appropriate by a person skilled in the art. In FIG. 7(A), the convex portion 18L of the PTP sheet 10L is disposed at each of the facing two corners of the cell 12L. Between the convex portions 18L, the pocket 16H of the PTP sheet 10H is disposed. Similarly, the convex portion 18H of the PTP sheet 10H is disposed at each of the facing two corners of the cell 12H. Between the convex portions 18H, the pocket 16L of the PTP sheet 10L is disposed. According to such arrangement, the gap between the PTP sheets 10L and 10H is maintained at the four corners of the PTP sheets 10L and 10H which are brought into the combined state. Then, the pockets 16L and 16H are disposed on the diagonal lines, respectively.

Modification 3

In FIG. 7(B), the PTP sheets 10L and 10H have only one convex portion 18L and only one convex portion 18H, respectively. In the PTP sheets 10L and 10H in the combined state, the convex portions 18L and 18H are disposed along the longitudinal direction 6. The pockets 16L and 16H each are disposed between the convex portions 18L and 18H. More specifically, the convex portions 18L and 18H and the pockets 16L and 16H are disposed on the straight line. According to such arrangement, the gap between the PTP sheets 10L and 10H is maintained by the convex portions 18L and 18H along the longitudinal direction 6. Then, the pockets 16L and 16H each are disposed between the convex portions 18L and 18H.

Modification 4

The pocket 16 and the convex portions 18 in each cell 12 may be disposed as illustrated in FIG. 8(A). In the embodiment described above, the pockets 16 and the convex portions 18 are asymmetrically disposed with respect to the virtual straight lines V1 and V2. In this modification, the pocket 16 and the convex portions 18 are asymmetrically disposed also with respect to a virtual straight line V3 along the center of the PTP sheet 10 in the horizontal direction 7. More specifically, the pocket 16 and the convex portion 18 are asymmetrically disposed with respect to all the virtual straight lines V1 to V3 of FIG. 8(A).

According to such arrangement of the pocket 16 and the convex portions 18, the two PTP sheets 10L and 10H can be brought into the combined state in such a manner the front end 21 (FIG. 2) and the back end 22 (FIG. 2) are brought into agreement with each other as illustrated in FIG. 8(B). Furthermore, as illustrated in FIG. 8(C), the two PTP sheets 10L and 10H can be brought into the combined state in such a manner the front ends 21 (FIG. 2) and the back ends 22 (FIG. 2) are brought into agreement with each other as illustrated in FIG. 8(C).

In FIG. 8(B), the PTP sheet 10L is in the state of FIG. 2 and the PTP sheet 10H is reversed in such a manner that the longitudinal direction 6 is reversed from the state of FIG. 2. Then, the PTP sheet 10H is placed over the PTP sheet 10L. This state is the same as that of the embodiment described above. On the other hand, in FIG. 8(C), the PTP sheet 10L is in the state of FIG. 2 and the PTP sheet 10H is reversed in such a manner that the horizontal direction 7 is reversed from the state of FIG. 2. Then, the PTP sheet 10H is placed over the PTP sheet 10L.

Thus, in this modification, when the PTP sheets 10L and 10H are brought into the combined state in such a manner that the outer edges of the sheets are overlapped with each other in the longitudinal direction 6 and the horizontal direction 7, also in the case where both the sheets are reversed in the longitudinal direction 6 (FIG. 8(B)) or reversed in the horizontal direction 7 (FIG. 8(C)), the pockets 16L and 16H and the convex portions 18L and 18H which face each other do not contact each other.

In FIG. 8(B), the pockets 16L and 16H are disposed between the convex portions 18L and 18H separated in the longitudinal direction 6. In FIG. 8(C), the pockets 16L and 16H are disposed between the convex portions 18L and 18H separated in the horizontal direction 7. More specifically, since the convex portions 18L and 18H are disposed on both the outside of the pockets 16L and 16H in both the cases, the gap between the PTP sheets 10L and 10H is easily maintained in the circumference of the pockets 16L and 16H, and a possibility that the pockets 16L and 16H contact the facing PTP sheets 10L and 10H is reduced.

Modification 5

In the embodiment described above, the seal 20 was attached to the first sheet 14, whereby the entry regions 17 were formed. However, the entry regions 17 may be formed by a different method. For example, the entry regions 17 may be formed by subjecting the upper surface of the first sheet 14 to sandblast processing or emboss processing.

When the sandblast processing is performed, small particles are collided to the first sheet 14, whereby irregularities are formed. When the emboss processing is performed, a heated roller with an unevenness shape on the surface or the like is pressed against the first sheet 14, whereby irregularities are formed in the surface. The surface of the first sheet 14 easily holds ink due to the formation of the irregularities, so that characters and patterns are easily indicated by pens and pencils, such as a pencil and a ball point pen.

Modification 6

Moreover, the entry regions 17 may be formed by coating the upper surface of the first sheet 14 with a material on which ink is easily placed. For the coating, a method, such as solution coating, extrusion coating, or vapor deposition, is used. As one example, a layer (one example of the material to be recorded of the present invention) of a paint containing titanium oxide may be formed by solution coating. The proportion of the titanium oxide contained in the paint is usually 18 to 36 wt % and preferably 24 to 32 wt %. After the formation of the coating on the entire upper surface of the first sheet 14, the pocket 16 and the convex portion 18 may be formed. In this case, the translucency of the first sheet 14 is maintained.

Modification 7

Figure 9:
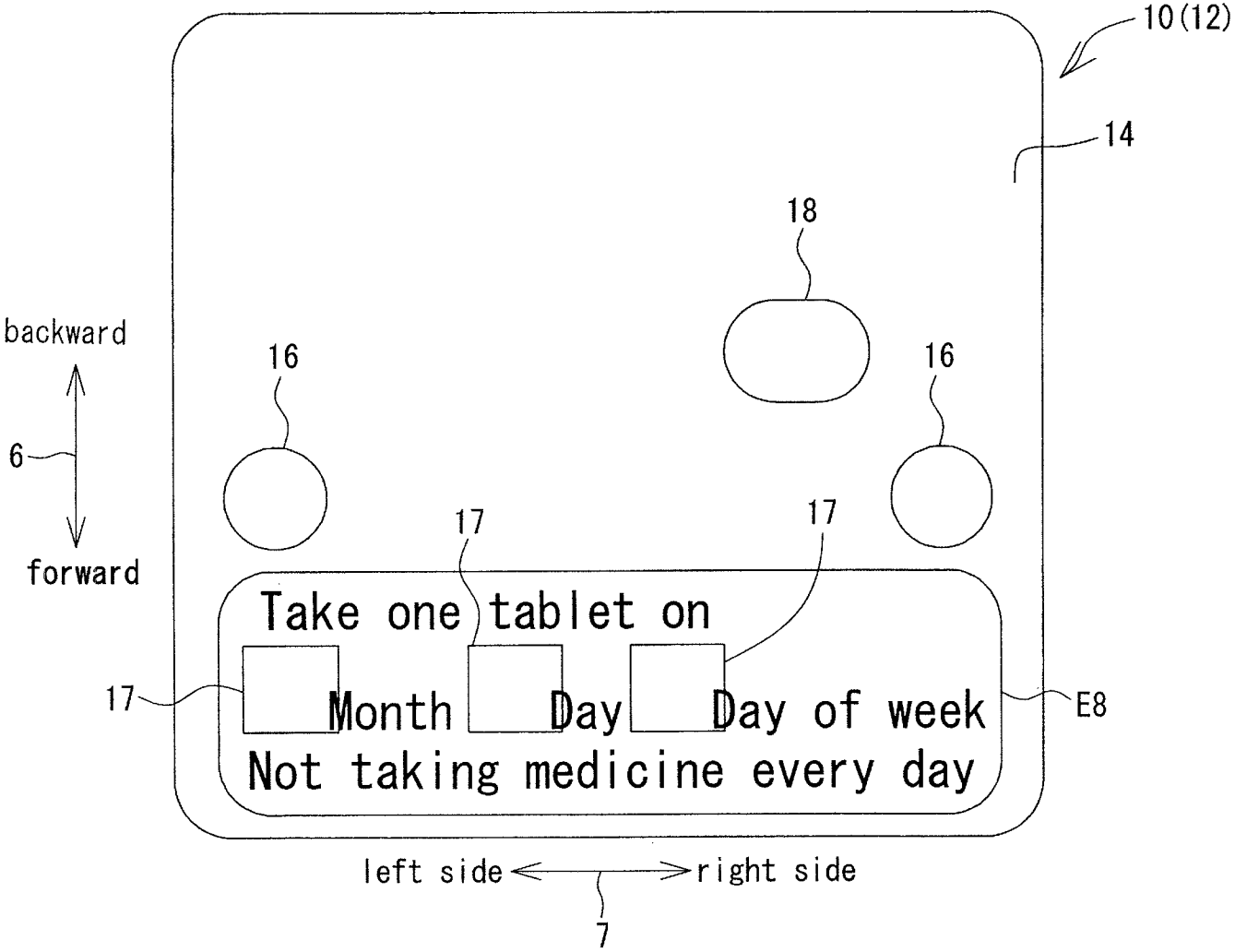
FIG. 9 is a view illustrating the PTP sheet according to Modification 7.

In the embodiment described above, the entry column in which the time when a patient takes the medicine 11 is entered may be constituted by the entry regions 17. In this modification, as illustrated in FIG. 9, the characters indicating "Month", "Day", and "Day of the week when you take one tablet" are indicated with spaces in the horizontal direction 7 on the upper surface of the second sheet 15. The entry regions 17 are formed in each region corresponding to the left side of each of the three indications on the upper surface of the first sheet 14. The entry regions 17 may be realized by any method among the methods described above.

For example, in the case where the day when a patient should take the medicine 11 is on Thursday, November 17, a pharmacist enters "11" in the left entry region 17, "17" in the center entry region 17, and "Thursday" in the right entry region 17, respectively. Thus, one sentence "Please take one tablet on Thursday, November 17" is constituted by the characters indicated beforehand on the second sheet 15 and the characters entered by the pharmacist in the entry regions 17.

When it is supposed that only the date can be confirmed from the upper surface of the first sheet 14, a patient cannot immediately understand the meaning of the date in some cases. Due to one sentence indicating the time when the patient should take the medicine 11 is constituted as in this modification, the patient can easily understand the time. Moreover, since the characters indicated on the upper surface of the second sheet 15 are not exposed to the open air, the characters do not become faint or disappear. Therefore, a possibility of misinterpretation of the patient due to misreading is low.

On the upper surface of the second sheet 15, a region E8 surrounding the one sentence may be colored with a color different from the color of the other portion to be made conspicuous. As illustrated in FIG. 9, on the upper surface of the second sheet 15, one supplement sentence of "Not taking medicine every day" may be indicated ahead the one sentence described above.

However, the one sentence is one example and one sentence different from the sentence described above may be constituted. For example, the entry region 17 in which any one of "Morning", "Noon", or "Evening" is to be entered may be further provided. By filling all the entry columns, one sentence, such as "Take one tablet after meal on Thursday, November 17", for example, may be constituted.

Other Modifications

In addition to the modifications above, the number and the arrangement of the convex portions 18 in each cell 12 may be altered as appropriate within the technical scope of the present invention. The shape of the pockets 11 and the convex portions 18 may be similarly altered as appropriate. The projection end of the convex portion 18 is not required to be a circular shape as viewed in a plane and may be a rectangular shape, for example.

From the upper surface of the first sheet 14, a rib or the like which abuts on the circumferential surface of the facing convex portion 18 may be projected in the PTP sheets 10L and 10H in the combined state. Thus, the relative displacement in the longitudinal direction 6 of the first sheet 14 and the horizontal direction 7 may be controlled.

The position and the size of the entry regions 17 may be altered as appropriate. For example, the entire upper surface of the first sheet 14 may be processed in such a manner that characters and patterns can be entered with pens and pencils, such as a pencil and a ball point pen. The characters and patterns to be entered to the regions E1 to E7 of the second sheet 15 may also be altered as appropriate according to the information to be given to a patient.

In the embodiment described above, although the two cells 12 are disposed along the longitudinal direction 6 in the PTP sheet 10 illustrated in FIG. 2, three or more cells 12 may be disposed. Or, a plurality of cells 12 may be disposed along the horizontal direction 7 or a plurality of cells 12 may be disposed along the longitudinal direction 6 and the horizontal direction 7. In any arrangement of the cells 12, the slit 13 is provided along the boundary of the cells 12.

REFERENCE SIGNS LIST

10 . . . PTP sheet
11 . . . Medicine
12 . . . Cell (one division)
13 . . . Slit (cutting portion)
14 . . . First sheet
15 . . . Second sheet
16 . . . Pocket
17 . . . Entry region
18 . . . Convex portion
20 . . . Seal (Material to be recorded, Third sheet)
23 . . . Depression
L1 . . . Distance (First distance)
L2 . . . Distance (Second distance)

The invention claimed is:

1. A medicine packaging press-through-package (PTP) having a rectangular shape as viewed in a plane and comprising a pair of cells, each one of the pair of cells comprising a first sheet and a second sheet, the first sheet having at least one pocket and at least one convex portion, said one pocket being configured to accommodate an item of medicine, said one convex portion defining an internal space configured to be absent of medicine, said one pocket and said one convex portion each projecting from a first surface, which is one of a front surface and a back surface of the first sheet, and the second sheet being attached to a second surface opposite to the first surface of the first sheet, the second sheet being configured relative to the first sheet to seal said item of medicine in said one pocket by blocking an opening of said one pocket; and wherein each one cell of said pair of cells has at least one said pocket and a pair of said convex portion;

wherein each one of said convex portions extend to a height from the first surface greater than a height to which said one pocket extends from the first surface;

wherein each pocket of said at least one pocket and each convex portion of said pair of convex portions are asymmetrical to any one of the pockets and any one of the convex portions with respect to a virtual straight line along a center in a longitudinal direction or a lateral direction of said plane;

wherein in a stacked arrangement of said pair of cells with edge peripheries of said first sheet of said each one cell of said pair of cells being in alignment, said at least one pocket and said each one convex portion of said pair of cells are offset out of vertical alignment and not in contact with any other pocket or convex portion, said each one convex portion of one of said pair of cells contacts the first surface of the first sheet of the other of said pair of cells, and said at least one pocket of one of said pair of cells does not contact the first surface of the first sheet of the other of the pair of cells so that a gap occurs between said at least one pocket of said one cell and a portion of the first surface of the other cell of said pair of cells directly aligned in a height direction with said at least one pocket.

2. The medicine packaging PTP sheet according to claim 1, wherein for each one cell of said pair of cells the projection end of each one of the convex portions is a plane parallel to the first surface.

3. The medicine packaging PTP sheet according to claim 1, wherein in said stacked configuration, for each one cell of said pair of cells each convex portion of said pair of convex portions is provided peripherally outward of all pockets of said pair of cells.

4. The medicine packaging PTP sheet according to claim 1, wherein for each one cell of said pair of cells a first one of said pair of convex portions is located toward a first end of the first sheet in the longitudinal direction, and a second one of the pair of said convex portions is located toward a second end, opposite the first end, of the first sheet in the longitudinal direction.

5. A medicine package, comprising:

a pair of cells;

each one of the pair of cells consisting of a first sheet having one medicine pocket and two non-medicine convex portions distinct from the medicine pocket, and a second sheet;

wherein the first sheet and the second sheet are arranged face to face so as to have a first surface of the first sheet contacting the second sheet;

wherein the medicine pocket is located along a horizontal direction of the first sheet, extends depthwise in a direction away from the second sheet to a first height, has an opening at the first surface, and has a size and shape adapted to accommodate an item of medicine;

wherein the second sheet is positioned relative to the medicine pocket to block said opening of the pocket for sealing the item of medicine in the pocket;

wherein the second sheet has a thickness and material adapted to allow the item of medicine to be pressed through the second sheet from the pocket;

wherein said two non-medicine convex portions project from the first surface in the direction away from the second sheet to a second height exceeding the first height;

wherein a first one of said two non-medicine convex portions is located closer than the medicine pocket to a first edge of the first sheet relative to the horizontal direction, and a second one of said two non-medicine convex portions is located closer than the medicine pocket to a second edge opposite the first edge relative to the horizontal direction;

wherein the medicine pocket and the two non-medicine convex portions of each one cell of the pair of cells are disposed asymmetrically relative to a center line of the first sheet extending in said horizontal direction;

wherein in a stacked arrangement of said pair of cells the medicine pocket of each one cell of said pair of cells is located more centrally along the horizontal direction than all non-medicine convex portions of both cells of said pair of cells, and the medicine pocket of each one cell of said pair of cells extends to said first height so that a gap occurs between said medicine pocket of said one cell and a portion of the first surface of the other cell of said pair of cells directly aligned in a height direction with said medicine pocket; and wherein in said stacked arrangement of said pair of cells, the two non-medicine convex portions of said one cell, the two non-medicine convex portions of said other cell, and the first sheet of said one cell are adapted to protect the medicine pocket of said other cell from pressurization in response to an external force.

6. The medicine package of claim 5, wherein each one of said two non-medicine convex portions defines an internal space extending to a height away from said first surface.

* * * * *